US007137863B2

(12) United States Patent
Hiebert

(10) Patent No.: US 7,137,863 B2
(45) Date of Patent: Nov. 21, 2006

(54) TOY HAVING TWO SLIDING BOBS ON A STRING WITH END STOPPERS

(76) Inventor: Matthew Bryan Hiebert, 4527 Vegas Road. NW, Calgary, Alberta (CA) T3A 0M9

( * ) Notice: Subject to any disclaimer, the term of this patent is extended or adjusted under 35 U.S.C. 154(b) by 125 days.

(21) Appl. No.: 10/850,661

(22) Filed: May 21, 2004

(65) Prior Publication Data

US 2005/0085307 A1 Apr. 21, 2005

Related U.S. Application Data

(60) Provisional application No. 60/473,059, filed on May 22, 2003.

(51) Int. Cl.
*A63H 33/00* (2006.01)

(52) U.S. Cl. ..... 446/490; 446/247; 446/242

(58) Field of Classification Search ..... 446/215, 446/242, 247, 252, 489, 490
See application file for complete search history.

(56) References Cited

U.S. PATENT DOCUMENTS 213,642 A * 3/1879 Farnum ..... 446/490
4,784,391 A * 11/1988 Herron ..... 273/109
4,878,868 A * 11/1989 Shaw ..... 446/75
5,906,846 A * 5/1999 Coleman et al. ..... 426/104
6,120,342 A * 9/2000 Chan ..... 446/254
6,332,851 B1 * 12/2001 Griffin ..... 473/577
6,629,873 B1 * 10/2003 Shaw ..... 446/490

* cited by examiner

*Primary Examiner*—Kien Nguyen
(74) *Attorney, Agent, or Firm*—Integral Patent Associates; Laurence J. Shaw

(57) ABSTRACT

A swinging bob toy having two bobs constrained to, yet slidable along, a string. Each end of the string has a pair of low-mass, spaced-apart stoppers which allows the end of the string to be easily grasped so that smooth transitions can be made between various modes of operation. The string is smooth enough and thick enough that it slides over the fingers and wrists with a minimum of friction and abrasion. The even number of bobs on the string allows for configurations with a symmetrical weight distribution so that one bob may act as an exact counterweight to the other bob.

8 Claims, 11 Drawing Sheets

TOY HAVING TWO SLIDING BOBS ON A STRING WITH END STOPPERS

RELATED APPLICATIONS

The present non-provisional patent application is based on provisional patent application Ser. No. 60/473,059 filed May 22, 2003 by Matthew Bryan Hiebert entitled "Toy having two sliding bobs on a string with end stoppers."

SUMMARY OF THE PRESENT INVENTION

The present invention, shown in FIG. 1A is a swinging bob toy (600) consisting of two or more bobs (613) on a string (650), where the bobs (613) are not fixed at the ends (651) of the string (650). The ends (651) of the string (650) have pairs of stoppers (631) and (634) which are spaced apart to form finger grips (640), which allow the ends (651) of the string (650) to be grasped, while leaving the bobs (613) free to slide along the string (650). At the present time, the preferred embodiment of the present invention (600) consists of two sliding bobs (613), with two sets of finger grips (640), smooth string (650) of 2–3 mm thickness, and lightweight wooden bobs (613) of 3–4 cm diameter.

Other design features of the present invention offer advantages over previous swinging bob toys:

- the thickness and smoothness of the string (650) allows it to slide over the fingers (642) and wrists (644) with reduced friction and abrasion;
- having an even number of bobs (613) means that the weight distribution is symmetrical—making some tricks and maneuvers easier to perform because one bob (613*a*) is an exact counterweight for the other bob (613*b*);
- having at least two sliding (as opposed to fixed) bobs (613) makes new modes of operation possible;
- and having two spaced-apart stoppers (631) and (634) at each end of the string (650) to form a low-mass finger grip (640) allows for smooth transitions between different modes of operation.

BRIEF DESCRIPTION OF THE FIGURES

The accompanying figures, which are incorporated in and form a part of this specification, illustrate embodiments of the invention and, together with the description given above and the detailed description of the preferred embodiments given below, serve to explain the principles of the invention.

The figures are drawn from the perspective of the operator, thus the left hand (643*a*) is on the left side of the figure, and the right hand (643*b*) is on the right side of the figure.

Dotted arrows are used to show the motion described by hands (643) and bobs (613). Dotted hands (643) and dotted bobs (613) are used to show future positions of the hands (643) and bobs (613). A double arrow converging indicates motion into the page, and a double arrow diverging indicates motion out of the page. A double arrow on an orbital path is the portion of that path which is relatively out of the page, and a single arrow on an orbital path is the portion of that path which is relatively into the page.

Figure 1A:
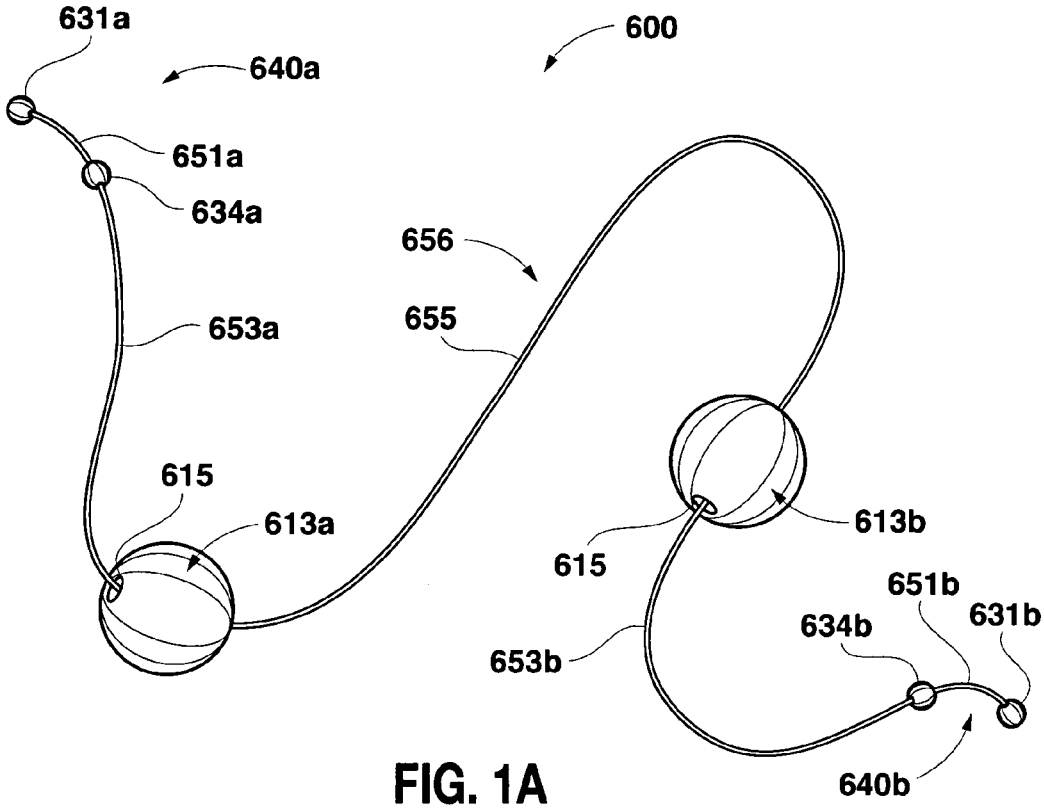
Figure 1B:
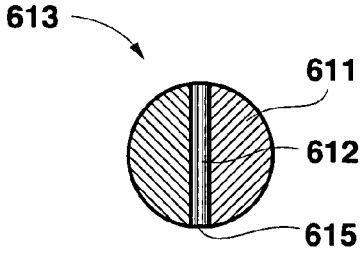
Figure 1C:
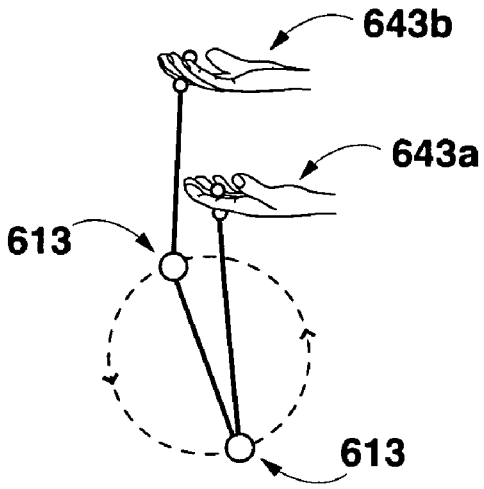
Figure 1D:
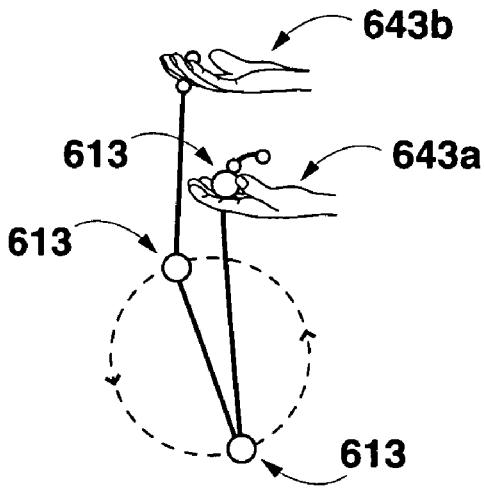
Figure 1E:
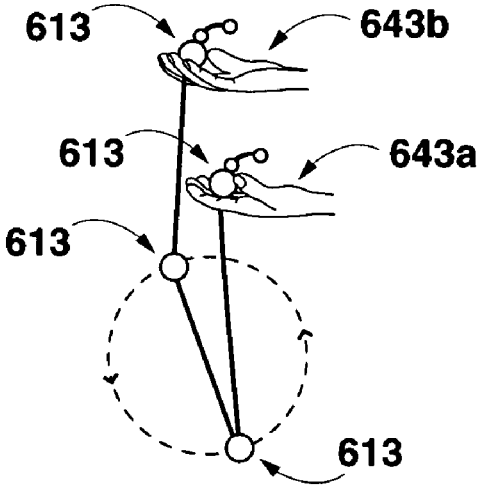

FIG. 1A shows a swinging bob toy (600) consisting of two sliding bobs (613) and two sets of finger grips (640). FIG. 1B shows a cross section of one bob. FIG. 1C shows a swinging bob toy consisting of two bobs (613) being operated as per the first mode of motion described below. FIG. 1D shows a swinging bob toy consisting of three bobs (613) being operated in the same way. FIG. 1E shows a swinging bob toy consisting of four bobs (613) being operated in the same way.

Figure 2A:
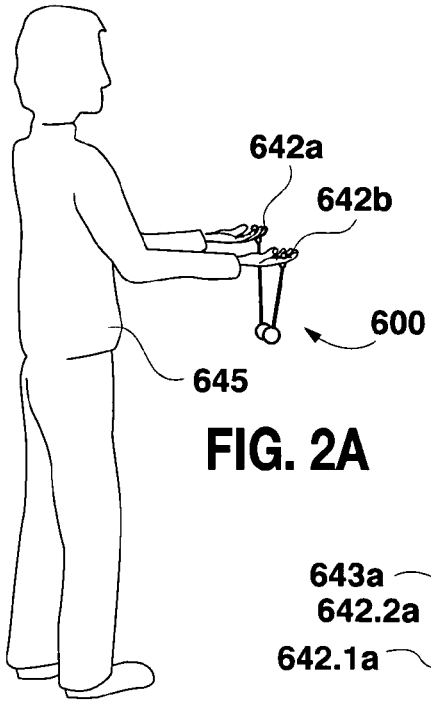
Figure 2B:
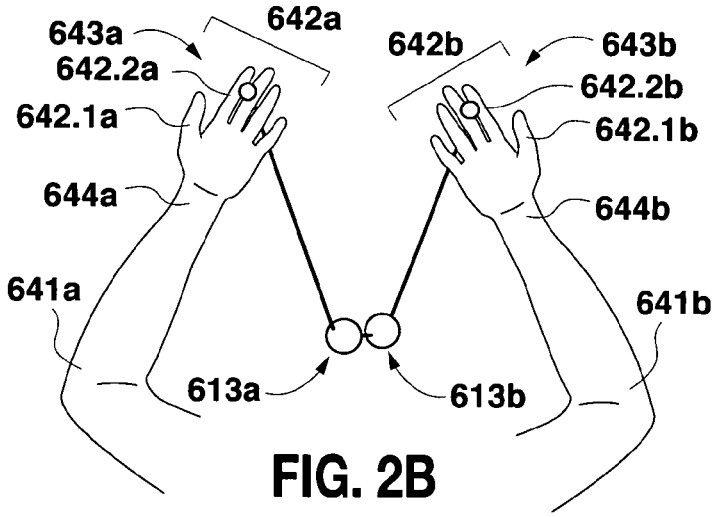
Figure 2C:
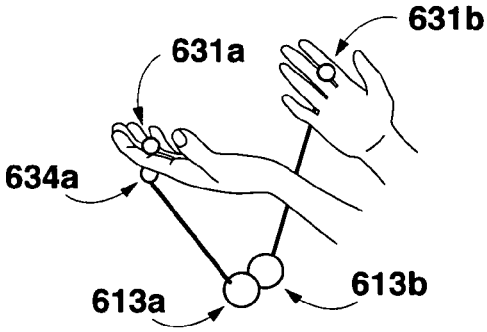

FIG. 2A shows an operator holding the preferred embodiment of the swinging bob toy (600) in the preferred position. FIGS. 2B and 2C show the preferred manner of grasping the swinging bob toy (600).

Figure 3A:
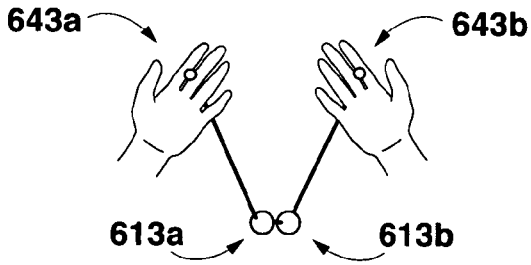

FIG. 3A shows the starting position for operation of the swinging bob toy (600).

FIGS. 4A–4D show a time sequence of the first mode of operation.

FIGS. 5A–5D show a time sequence of the second mode of operation. FIG. 5E shows an top down view of the second mode of operation.

FIGS. 6A–6I show a time sequence of the third mode of operation.

Figure 7A:
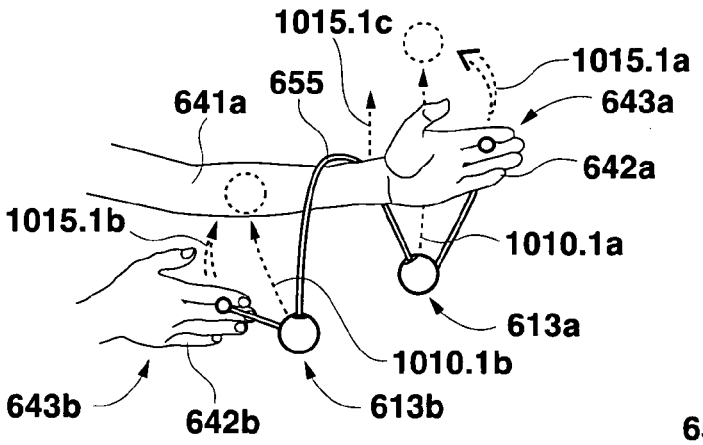
Figure 7B:
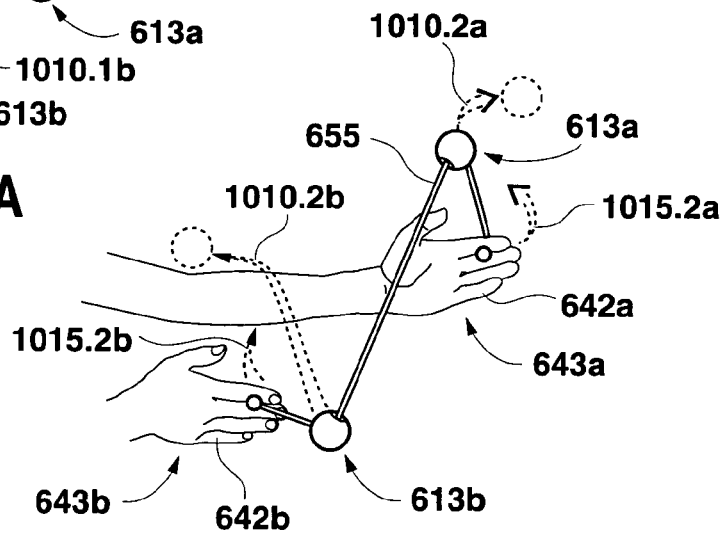
Figure 7C:
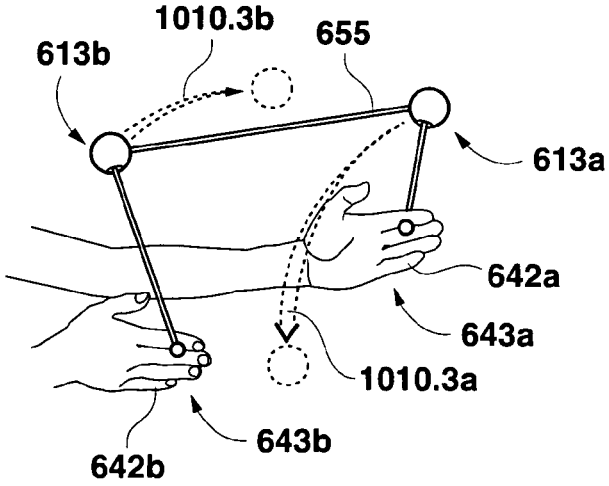

FIGS. 7A–7F show a time sequence of the fourth mode of operation. FIG. 7G shows how transitions can be made between the fourth mode of operation and other modes of operation.

FIGS. 8A–8D show a time sequence for the fifth mode of operation.

Figure 9A:
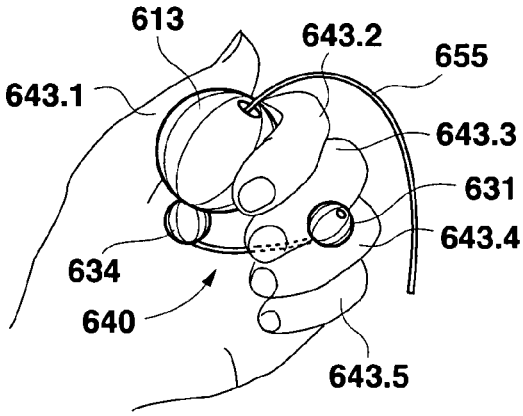
Figure 9B:
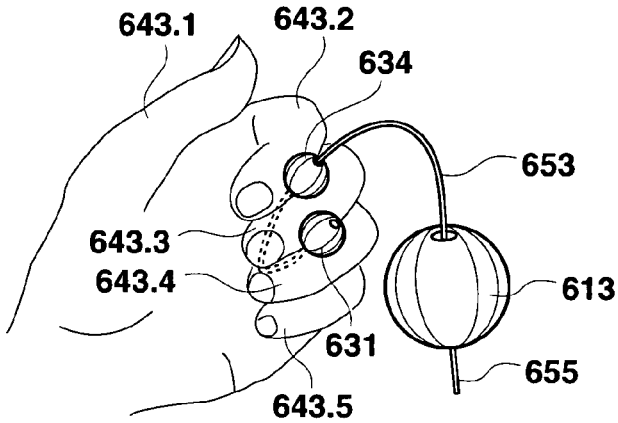
Figure 9C:
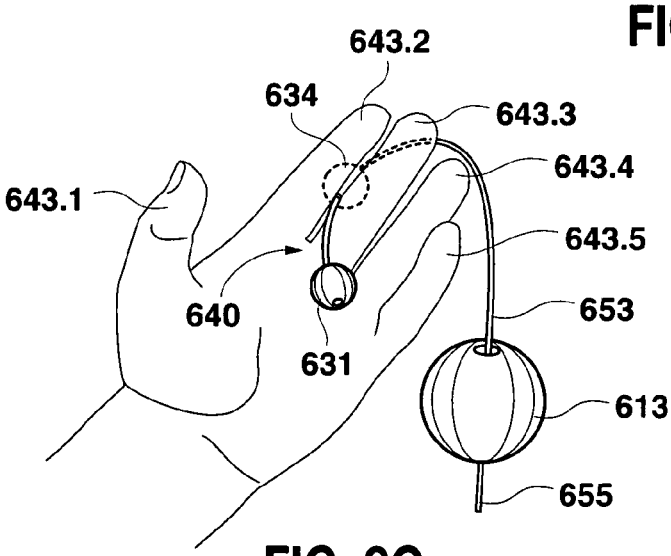

FIGS. 9A–9C shows a manner of holding the finger grip (640) so that the bob (613) can be easily released.

DETAILED DESCRIPTION OF THE PREFERRED EMBODIMENTS

Figure 4A:
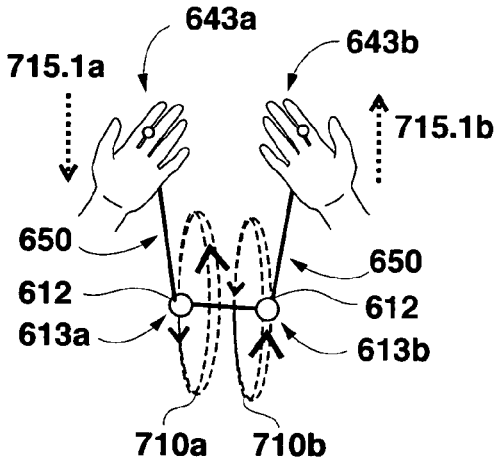
Figure 4B:
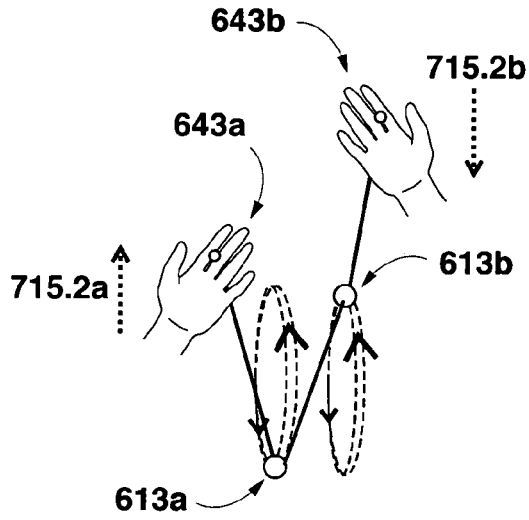
Figure 4C:
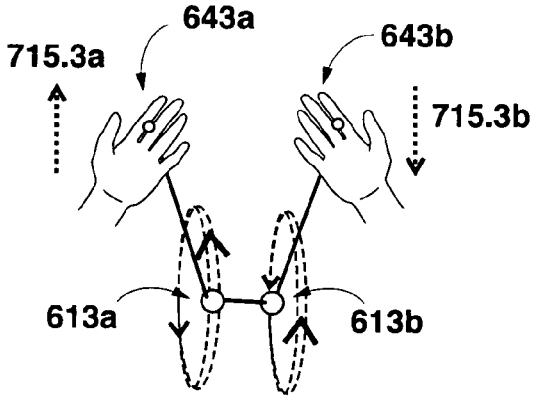
Figure 4D:
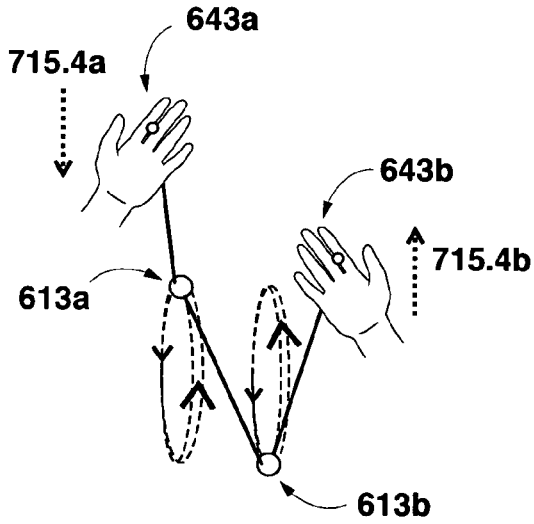

As shown in FIG. 1A, the present invention is a swinging bob toy with two bobs (613), a string (630) and two pairs of end grips (631) and (634). A bob (613), as shown in FIGS. 4A and 4B, is a weight with a throughbore (612), through which the string (650) passes. The bobs (613*a*) and (613*b*) can be of any shape or size, however the weight distribution should be roughly cylindrically symmetrical around the throughbore (612). The preferred embodiment of the present invention utilizes a roughly spherical bob (613) of approximately 3–4 cm diameter, composed of wood, with a throughbore (612) of approximately 5 mm diameter. The string (650) can be of any length, thickness, or material, however the preferred embodiment of the present invention has a string which is 2–3 mm thick, roughly 1 m long, and made of a smooth and tightly knit nylon. The finger grips (640) of the string consist of two spaced-apart stoppers (631) and (634). The stoppers (631) and (634) can be made from any material, but their mass should be minimal in order to avoid distortions in the operation of the swinging bob toy (600). The stoppers (631) and (634) should be small in size, relative to the bobs (613), but must be larger than the throughbore (612) in order to prevent them (631) and (634) from sliding through it (612). The stoppers (631) and (634) should be spaced apart by approximately 4 cm. The preferred embodiment of the present invention uses stoppers (631) and (634) which are made from lightweight plastic beads which are secured to the string (650) or from creating large decorative knots in the string (650) at the correct points.

The finger grips (640) allow an end stopper (631*a*) or (631*b*) to be grasped while the adjacent bob (613*a*) or (613*b*), respectively, remains in motion, forcing the bob (613*a*) or (613*b*) to slide down the string (650) and away from the adjacent stoppers (631*a*) and (634*a*) or (631*b*) and (634*b*), respectively. The length of string (651) between the two stoppers (631) and (634) also allows the finger grip (640) to be grasped between two fingers (642.3) and (642.4) while the bob itself (613) is being held in the operator's hand (643). This allows the operator to drop the bob (613) without dropping the finger grip (640) and without struggling to find the finger grip (640) before dropping the bob (613). This process of releasing the bob (613) while retaining the finger grip (640) is shown in FIGS. 9A–9C.

At least five novel modes of operation are enabled by design features of the present invention. The first four modes of operation involve holding the finger grips (640*a*) and (640*b*) (i.e., the sections of the string (650) which lie between the two sets of stoppers (631*a*) and (634*a*) and (631*b*) and (634*b*) with the left and right hands (643*a*) and (643*b*) respectively, as shown in FIGS. 2B, 2C, and 9C. With the toy (600) held in this manner, the two bobs (613), are free to slide along the string (650), and by oscillating the hands (643), the bobs (613) can be made to separate and orbit around one another in a variety of regular and irregular paths. For these modes of operation, there must be sufficient friction between the throughbore (612) and the string (650), and the masses of the bobs (613) must be small enough that the bobs (613) do not slide too readily to the potential-energy minimizing position.

The fifth mode of operation is also facilitated by design features of the present invention, taking advantage of the separation between the outer stopper (631) and the bob (613). Having an outer stopper (631) near the end of the string (650) but separated from the inner stopper (634) allows the end of the string (650) to be released and then easily regrasped, regardless of whether or not the bob (613) is flush against the inner stopper (634).

The first mode of operation is depicted in FIGS. 4A through 4D. In the first mode of operation, the two hands (643) rhythmically alternate tugging upwards on the finger grips (640). Although the hands (643) are in motion, they remain at roughly the same height. This tugging causes the two bobs (613) to separate and to describe simultaneous, roughly circular, vertical orbits (710*a*) and (710*b*) which are 180 degrees out of phase from one another (710*b*) and (710*a*). As shown in FIG. 4A, at one point in this mode of operation, the righthand bob (613*b*) has an upward velocity, and the lefthand bob (613) has a downward velocity. The friction between the string (650) and the throughbore (612) at this moment must be sufficient to allow the right hand (643*b*) to pull up and make the right bob (613*b*) follow up accordingly.

FIG. 3A shows the starting position of the hands (643) and the toy (600) for the first mode of operation. Giving a short tug with one hand (643*a*) and then the other hand (643*b*) will immediately cause the two bobs (613) to separate from one another. Once the bobs (613) have separated, the hands (643) begin a rhythmic tugging on the string (650), with the motions (715) of the hands (643) being 180 degrees out of phase with each other. The speed and size of the motions (715) will dictate the size and speed of the orbits (710) performed by the bobs (613): the smaller and quicker the tugs, the smaller and quicker the orbits. The diameters of each of the orbital paths (710) is roughly equal to the vertical distance traveled (715) by each of the hands (643). When performing larger orbits, the portion (655) of the string (650) between the bobs (613) increases in length, and the two portions (653) of the string (650) between the bobs (613*a*) and (613*b*) and the hands (640*a*) and (640*b*), respectively, decrease in length. It should be noted that for large orbits, a simple vertical motion (715) of the hands (643) will result in tangling of the string (650) about the bobs (613) and more circular motions, similar to the motion described by the two bobs (613) or by the feet while pedaling a bicycle, are necessary.

The hand positions for this mode of motion are slightly above waist height, and approximately separated by the width of the player's torso, as shown in FIG. 2A. The finger grips (640) can be held in any manner by their respective hands (643), but for versatility in the various modes of operation it is convenient to hold the string (651) between the end stoppers (631) and (634), between the index finger (642.2) and middle finger (642.3) of each hand (643), with the palms facing roughly towards the player's chin, and the rest of the bob toy (600) hanging down below the backs of the hands (643) as shown in FIGS. 2A through 2C.

The second mode of operation is depicted in FIGS. 5A through 5D. The second mode of operation involves an alternating tugging of the hands (643) at an angle of approximately 45 degrees to the horizontal plane. The horizontal portion of this force is either clockwise or counter-clockwise vis a vis the horizontal plane, which causes the two bobs (613) to describe a more complex double orbital path (810), as shown in FIGS. 5A through 5D. In this example the two bobs (613) describe orbital paths (810) in the counterclockwise direction which are 180 degrees out of phase with one another. The double orbital path has an upper orbit and a lower orbit. In this mode of operation, one of the bobs (613*a*) is describing an upper orbit while the other bob (613*b*) is describing a lower orbit, and vice versa.

Figure 5A:
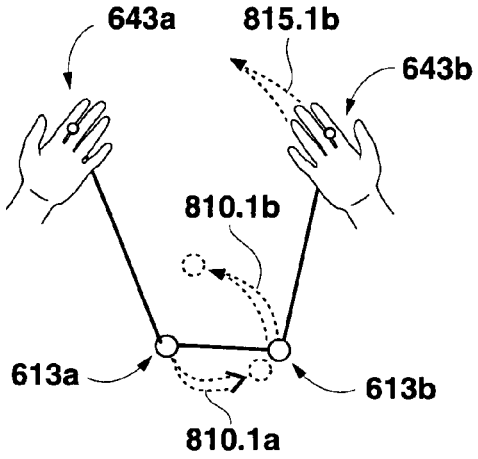
Figure 5B:
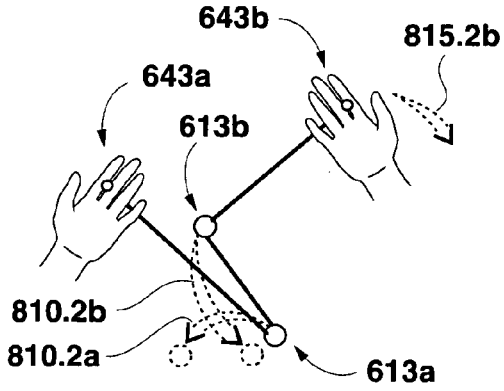
Figure 5C:
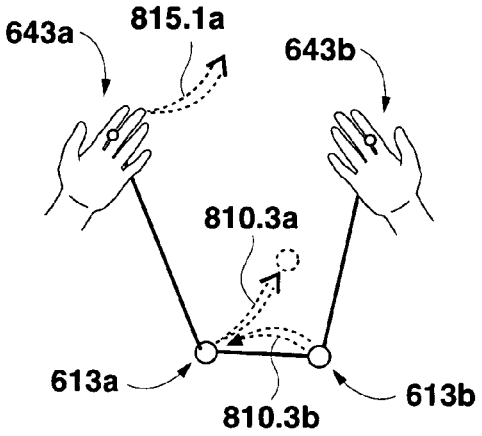

The double orbital path (810) of the bobs (613) is shown in FIGS. 5A through 5D. In FIG. 5A the righthand bob (613*b*) begins on an upper orbit (810.1*b*) which is at approximately 45 degrees to the horizontal, and the lefthand bob (613*a*) simultaneously begins a roughly horizontal lower orbit (810.1*a*). As the righthand bob (613*b*) reaches the top and leftmost position of its orbital path (as indicated by the dotted bob (613*b*) in FIG. 5B) the lefthand bob (613*a*) reaches the rightmost position of its orbital path (as shown by the dotted bob (613*a*) in FIG. 5B). The two bobs (613) then continue along their respective orbital paths (810.2) back to their original starting positions as shown in FIG. 5C.

Figure 5D:
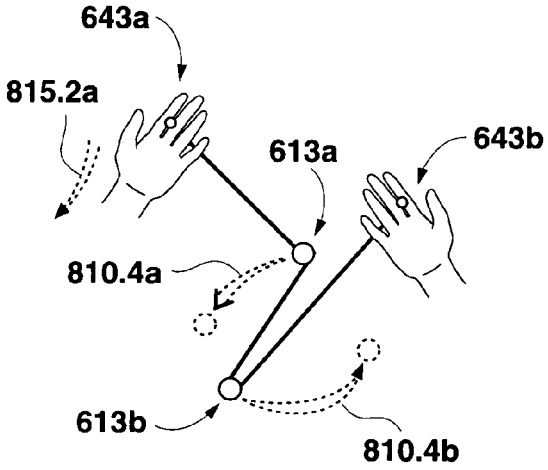
Figure 5E:
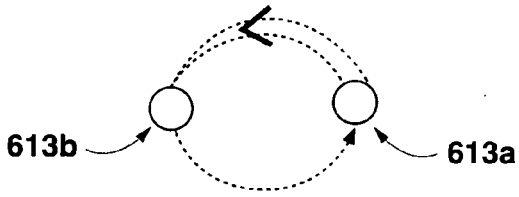

The second half of the double orbital path is shown in FIGS. 5C and 5D: the righthand bob (613*b*) describes a lower orbit which is the mirror image of the orbit described previously by the lefthand bob (613*a*); simultaneously, the lefthand bob (613*a*) describes an upper orbit which is the mirror image of the one described previously by the right-hand bob (613*b*). If viewed from above, the two bobs (613) would appear to be describing simultaneous horizontal circular orbits, 180 degrees out of phase, with both bobs (613) describing roughly the same trajectory on the horizontal plane. This view from above is shown in FIG. 5E which corresponds to the positions of the bobs (613) in FIG. 5D. Note that the lefthand bob (613*a*) is on a descending path, and the righthand bob (613*b*) is on a horizontal path which will lead the two bobs (613) back to their original positions shown in FIG. 5A.

For this mode of operation, the position of the hands (643) should be approximately shoulder width apart, and at the height shown in FIG. 2A and the grasp of the end grips (640) is shown in FIGS. 2B and 2C. This mode of operation begins with the vertical orbits described in FIGS. 4A through 4D. Once vertical orbits are achieved, the hands begin to exert an alternating force (815) at roughly 45 degrees to the vertical, at an interval roughly twice that of the interval of the tugging in the first mode of operation. The vertical portion of this force (815) is the same as described in the first mode of operation, and the horizontal portion of this force (815) causes the bobs (613) to incorporate a horizontal component into their orbits (810). This horizontal portion of the force (815) must be in a consistent direction, either clockwise or counterclockwise. The example of a counterclockwise direction is developed below.

The dotted arrows in FIGS. 5A through 5D show the paths of the hands (643) and bobs (613) in the second mode of operation. To begin the counterclockwise orbiting, the right hand (643*b*) tugs upwards and around towards the left in an arc which takes it slightly away from the body, as the righthand bob (613*b*) is ascending on its orbital path (815.1*b*). This sends the righthand bob (613*b*) up, into the page, and over the lefthand bob (613*a*). This, causes the lefthand bob (613*a*) to be pulled out of the page and around towards the right as a reaction to the movement of the righthand bob (613*a*). In short, the righthand bob (613*a*) begins an upper orbit (810.1*b*) which is at roughly 45 degrees to the horizontal and sloped upwards towards the left, while the lefthand bob (613*b*) begins a lower orbit (810.1*a*) underneath it (613*b*), which is roughly horizontal. Throughout the duration of this step in the second mode of operation, the left hand (643*a*) is almost motionless, with the only force applied to the toy (600) coming from the initial, diagonal tug of the right hand (643*b*). As with the first mode of operation, the diameter of the orbits (810) is determined by the distance and force of the tugs applied (815).

After the two bobs (613) have completed their orbits (810.2) to (810.2) as described above and outlined in FIGS. 5A and 5B, and have returned to their original positions again (as shown in FIG. 5C), the left hand performs a mirror image (815.1*a*) of the motion previously applied by the right hand (815.1*b*), by giving a tug upwards and in an arc (815.1*a*) out of the page and towards the right. This sends the lefthand bob (613) on a path (810.3*a*) upwards, out of the page, and to the right, which causes the righthand bob (613*b*) to begin a lower orbit (810.3*b*) which is almost horizontal, in reaction to the movement of the lefthand bob (613*a*). The orbits (810.3*a*) to (810.4*a*) and (810.3*b*) to (810.4*b*) of the two bobs (613*a*) and (613*b*) respectively, in this stage are shown in FIGS. 5C to 5D: the lefthand bob (613*a*) begins an upper orbit (810.3*a*) to (810.4*a*) which is at roughly 45 degrees to the horizontal and sloped upwards towards the right, while the righthand bob (613*b*) begins a lower orbit (810.3*b*) to (810.4*b*) underneath it, which is roughly horizontal. Through the duration of this step in the second mode of operation, the right hand (643*b*) is almost motionless, with the only force applied to the toy coming from the initial, diagonal tug (815.1*a*) of the left hand (643*a*).

In a third mode of operation, the bobs (613) describe an even more complex path which has three stages. The first stage is shown in FIG. 6A to 9D: the bobs (613) circle roughly horizontally around one wrist (644*a*) which is held up vertically. In the second stage, the bobs (613) circle around the other wrist (644*b*) roughly horizontally with an orbital path of a similar size, as shown in FIGS. 6E to 6G. In the third stage, the bobs (613) perform a final orbit below both hands (643), which is also roughly horizontal, as shown in FIGS. 6H and 6I. In all three orbits, the orbital diameter is roughly equal to half of the overall string (650) length, and the orbital paths in all three stages are nearly vertically aligned with one another. Although each of the two bobs (613) performs a total of three orbits, the paths followed by the two bobs (613) are not identical. In the first and third stages (FIGS. 6A to 6D and 6H to 6I) the righthand bob (613*b*) leads and the lefthand bob (613*a*) follows 180 degrees behind it (613*b*). In the second stage (see FIGS. 6E to 6G) the lefthand bob (613*b*) leads, and the righthand bob (613*b*) follows 180 degrees behind it. The three stage path of the bobs (613) in this mode of operation is shown by the time sequence in FIGS. 6A to 6I. As with the first two modes of operation, the orbital diameter of the paths (910) of the two bobs (613) is correlated to the force applied by the hands (643) and the distance that the hands (643) travel (915).

For this mode of operation, the position of the hands (643) and the grasp of the finger grips (640) is the same as with the second mode of operation (see FIGS. 2A to 2C). FIGS. 6A to 6I show a time sequence for this mode of operation in a counter-clockwise direction, but like the second mode of operation, it can be reversed for a clockwise motion.

Figure 6A:
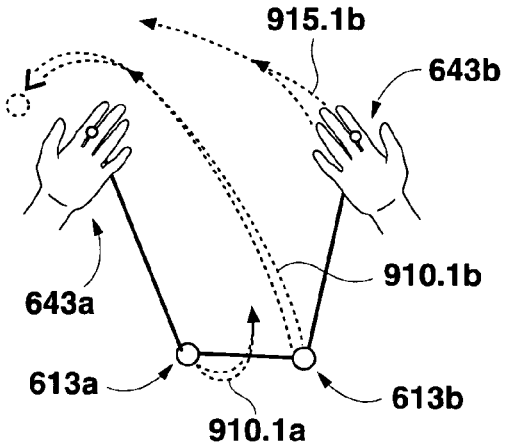
Figure 6B:
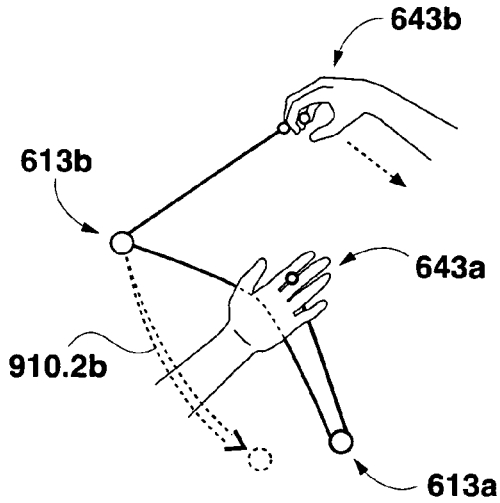
Figure 6C:
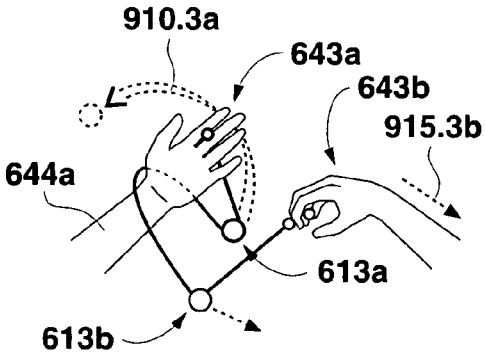
Figure 6D:
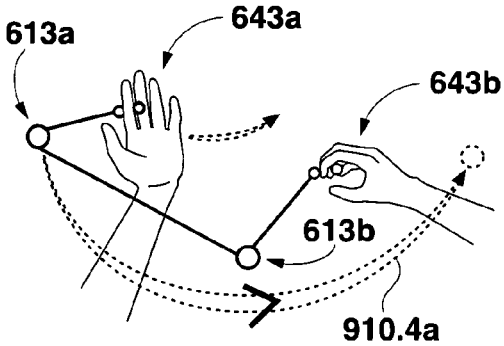
Figure 6E:
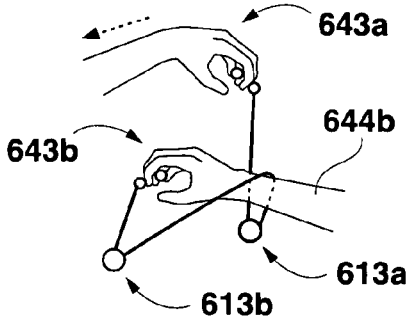
Figure 6F:
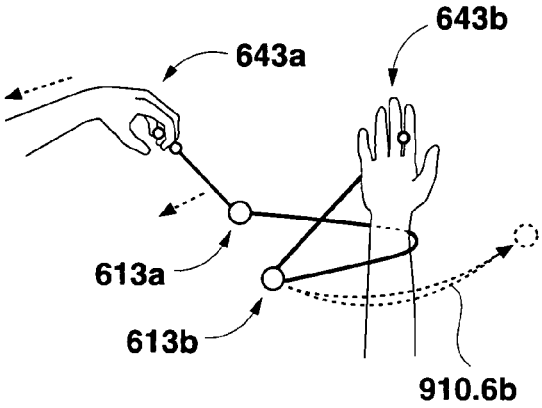
Figure 6G:
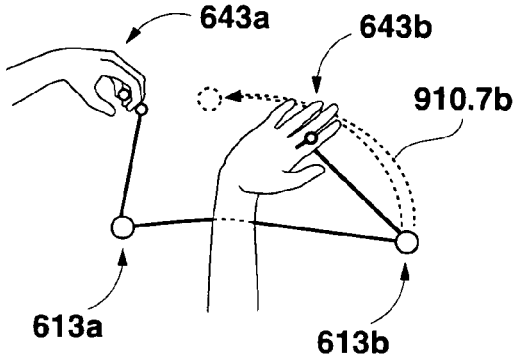
Figure 6H:
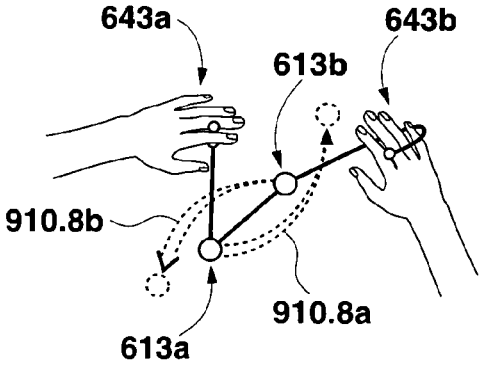
Figure 6I:
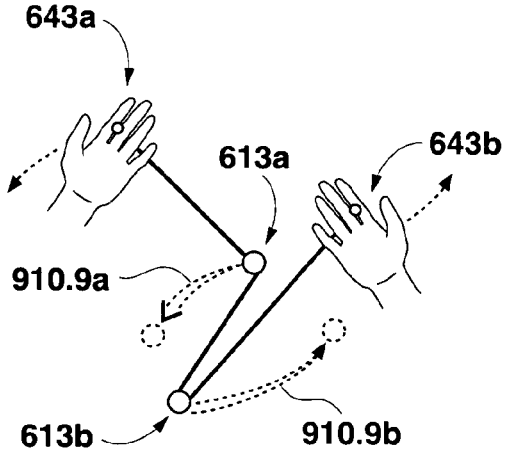

To begin the third mode of operation, the right hand (643*b*) gives a diagonal tug (915.1*b*) upwards and towards the left at an angle of roughly 45 degrees to the horizontal, as shown by the dotted arrow (915.1*b*) in FIG. 6A. The tug of the right hand (643*b*) is much more exaggerated than in the second mode of operation, and the right hand (643*b*) pulls up to a position directly above the left hand (643*a*), and approximately one hand-width above it, as shown in FIG. 6B. This exaggerated motion sends the righthand bob (613*b*) upwards, into the page, and around towards the left along an arc (910.1*b*) in FIG. 6A; which then leads it (613*b*) outside of the left wrist (644*a*) as shown in FIG. 6B; and back towards the player (910.2*b*) as shown in FIG. 6C; and across again to the righthand side, as shown in FIG. 6D. Throughout this motion, the left hand (643*a*) stays relatively still and by the end of this stage, the string (655) is wrapped sideways around the left wrist (644*a*) such that the righthand bob (613*b*) is on the side of the left wrist (644*a*) which is out of the page, and the lefthand bob (613*a*) is on the side of the left wrist (644*a*) which is into the page.

The second stage of the third mode of operation (shown in FIGS. 6C to 6G) is continuous with the first stage (shown in FIGS. 6A to 6D), and the momentum of the two bobs (613) is carried from the first stage into the second stage with no pause. The second stage begins when the righthand bob (613*b*) has passed around the lefthand side of the left wrist (644*a*) and has crossed back to the righthand side, and the string (655) is draped around the outside of the player's wrist (644), as shown in FIG. 6C. At this point, the right hand (643*b*) pulls gently downwards and to the right at an angle of roughly 45 degrees to the horizontal (915.3*b*). This motion creates tension on the string (650) and begins to send the righthand bob (613*b*) downwards one the left side of the right wrist (644*b*), as shown in FIG. 6D. The left hand (643*a*) then uses a flick of the fingertips (642*a*) to pull the lefthand bob (613*a*) around the lefthand side of the left wrist (644*a*) and out of the page. As the lefthand bob (613*a*) crosses the body (645), the left hand (643*a*) leads it (613*a*) across so that the left hand (643*a*) is above the right wrist (644*b*) in a mirror image of the position shown in FIG. 6B. The lefthand bob (613*a*) then swings around the right wrist (644*b*) to the position shown in FIG. 6E.

The third stage in this mode of operation begins in FIG. 6F as the left hand (643*a*) pulls downwards and towards the left, back to its original position. This creates tension on the string, and begins to send the lefthand bob (613*a*) downwards on the right side of the left wrist (644*a*). The right hand (643*b*) then uses a flick of the fingertips (642*b*) to pull the righthand bob (613*b*) around the righthand side of the right wrist (644*b*) as shown by the dotted arrows (910.6*b*), into the page, and then downwards below the lefthand bob (613*a*), as shown in FIG. 6G. As the righthand bob (613*b*) reaches the leftmost portion of this roughly horizontal orbit, it is approximately even in height with the lefthand bob (613*a*) which is—at that moment—at the rightmost position of its orbit. The two bobs (613) then complete this final orbit and return to their original starting positions, exactly as shown in FIG. 6A. Their present momentum is then carried on to repeat this time sequence.

In a fourth mode of operation, the two finger grips (640) are held in either hand (643) with the grip shown in FIG. 2C, however the two bobs (613) are draped on either side of one wrist (644). In this example, the bobs (613) are suspended from the left wrist (644*a*), so that the lefthand bob (613*a*) is hanging on the side of the wrist (644*a*) that is into the page, and the righthand bob (613*b*) is hanging on the side of the wrist (644*a*) which is out of the page, as shown in FIG. 7A. The dotted arrows (1015.1) and (1010.1) in FIG. 7A show the paths that will be taken by the fingers (642) and the left wrist (644*a*), and the bobs (613) respectively. By moving the left wrist (644*a*) upward (1015.1*c*), and at the same time using the fingers of both hands (642*a*) and (642*b*) to flick the end grips (640) upwards and across the left wrist (644*a*) towards the opposite sides, the bobs (613) are made to hop across the left wrist (644*a*) and land on the opposite sides. This motion is shown by the time sequence in FIGS. 7B to 7E. FIG. 7E shows the finishing position, with the string (655) again draped across the back of the left wrist (644*a*).

This motion can be repeated, reversing the direction in which the fingertips (642) flick the finger grips (640), to send the bobs (613) back to their original starting positions (as shown in FIG. 7A). Or, by shifting the position of the hands (643) and wrists (644) while the bobs (613) are in mid-air the bobs (613) can be flicked so that the string (655) is made to land on the right wrist (644*b*), or on both wrists (644*a*) and (644*b*) simultaneously. In addition, if the wrists (644) are positioned so that the string (655) does not land on either one, the bobs (613) fall into the position shown in FIG. 7G, which allows the player to smoothly transition into another mode of operation.

In the fourth mode of operation, the grip of the string is the same as the other modes of operation (see FIG. 2C) however, the position of the hands (643) is not the same. In order to keep the string from getting tangled as the bobs (613) hop across the wrist (644), the wrist (644) on which the string (655) is draped, in this case the left wrist (644*a*) is held out in front of the player's body (645), and the opposite hand (643*b*) is held close to the left elbow (641*a*). In this way, the two bobs (613) are separated by a relatively long center portion (655) of the string (650), and when the bobs (613*a*) and (613*b*) cross the wrist (644*a*), as shown in the time sequence FIGS. 7B to 7D, they do not come in contact with the string (655) or with one another (613*b*) and (613*a*). This mode of operation relies heavily on vertical lift from the two hands (643), from the wrist (644) on which the string (655) is draped, and on a flicking motion from the fingers (642) of both hands (643) to send the bobs towards the opposite sides.

Figure 7D:
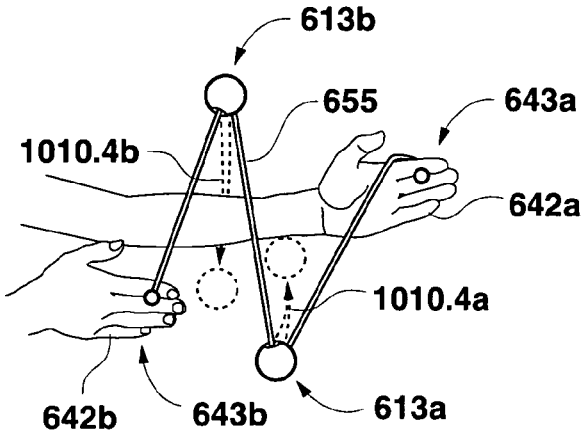
Figure 7E:
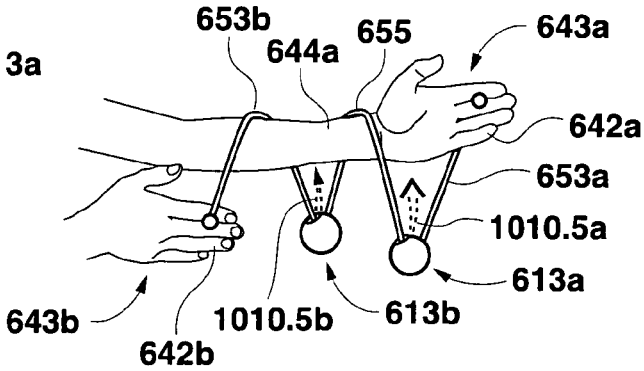

Starting with the hand position shown in FIG. 7A, FIGS. 7A to 7E show a time sequence of the fourth mode of motion. The motion begins by moving the left wrist (644*a*) and hand (643*a*), and the right hand (643*b*) gently but quickly upwards, simultaneously, from approximately waist height to approximately chest height. At the top of this motion, the two bobs (613) have upward momentum, which is transformed into horizontal momentum towards the opposite sides by flicking the fingers (642) of each hand (643) towards the opposite sides, as shown by the curved dotted arrows (1015.1*a*) and (1015.1*b*) in FIG. 7A, and (1015.2*a*) and (1015.2*b*) in FIG. 7B. Thus, in FIG. 7A, the two bobs (613) begin their motion upwards (1010.1). They (613) then, in FIG. 7B, describe simultaneous arcs (1010.2) in parallel but opposite directions; crossing past one another (in FIG. 7C) while overtop of the left wrist (644*a*); and then describe simultaneous arcs back downwards on the opposite sides of the left wrist (644*a*) (as shown in FIG. 7D); until they come to rest on the opposite sides of the left wrist (644*a*) with the string (655) draped across the top of the left wrist (644*a*), as shown in FIG. 7E.

Figure 7F:
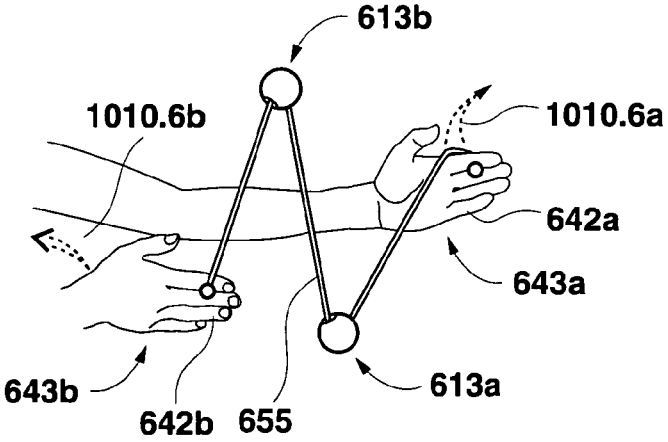
Figure 7G:
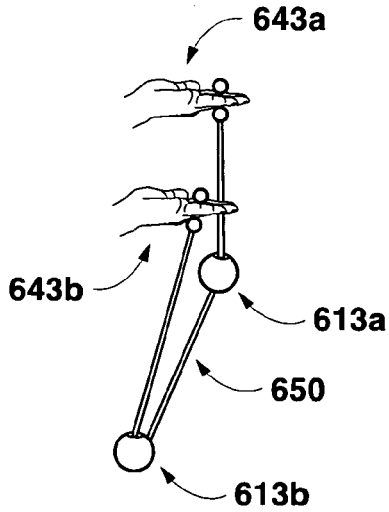

In order to return the bobs (613) to their original positions, the above sequence must be repeated in every respect, except that the flick of the fingers (642) of each hand (643), instead of being towards the opposing sides (as in FIG. 7A), is towards the side of origin, as shown by the dotted arrows in FIG. 7F. This motion begins with a vertical lift from both hands (643) and the left wrist (644*a*), as was the case in FIG. 7A. Once the hands (643) have reached chest height, the fingers (642) flick the bobs (613) back towards their original side: the right hand (643*b*) flicks the right bob (613*b*) towards the right, and the left hand (643*a*) flicks the left bob (613*a*) towards the left. In this manner, the bobs (613) perform the reverse of their original motions, thus landing in their original positions shown in FIG. 7A.

A fifth mode of operation which takes full advantage of the end grips (640) is shown in FIGS. 8A to 8D. When the swinging bob toy (650) is held in one hand (643*b*), and is in motion with one bob (613*a*) resting against the inside end stopper (634*a*), the other hand (643*a*) can grasp the end grip (640*a*) easily, without grasping the bob (613*a*) itself. This allows the bob (613*a*) to slide down the string (650) without stopping its motion.

Figure 8A:
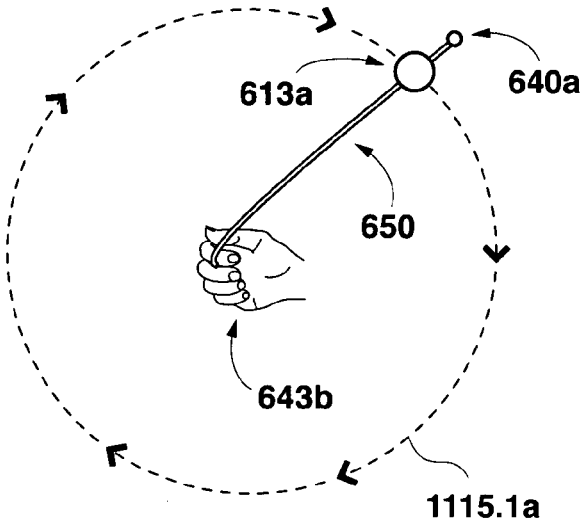
Figure 8B:
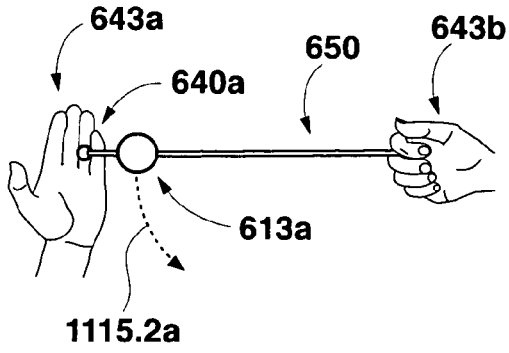
Figure 8C:
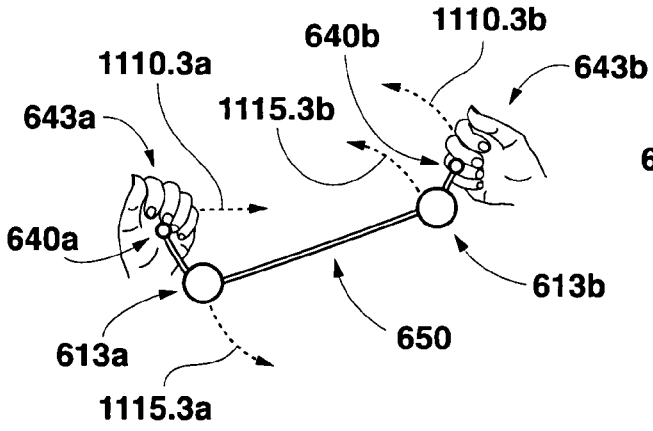
Figure 8D:
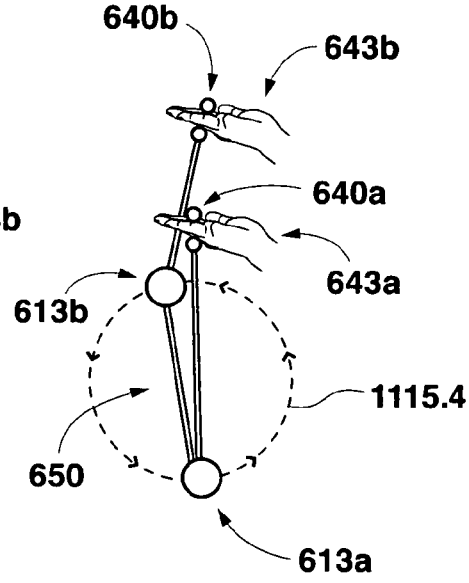

The time sequence in FIGS. 8A to 18 shows this mode of operation. In FIG. 8A the lefthand bob (613*a*) is being swung in a large circular orbit (1110.1*a*) at the full length of the string (650). In FIG. 8B the left hand (643*a*) is grabbing the lefthand finger grip (640*a*), but not the lefthand bob (613*a*). In FIG. 8C, the lefthand bob (613*a*) is sliding down the string (650) while the righthand bob—but not the righthand end grip—is simultaneously released by the right hand (643). The dotted arrow (1115.3*b*) in FIG. 8C shows the path of the right hand (643*b*) beginning an arcing motion upward and forward which will give the righthand bob (613*b*) an arcing upward and forward motion (1115.3*b*) This arcing motion (1115.3*b*) is the start of a vertical orbit, such as those described in FIGS. 4. In FIG. 8D the two bobs have begun vertical orbits such as those described in FIGS. 4.

The modes of operation which can be performed with the present invention (600) are not limited to those listed above. The modes of operation listed above are those which are unique to the present invention.

Possible Variations

The swinging bob toy may have a non-cylindrically symmetric weight distribution, but not have functional components other than structural components, such as struts, ribs, means for attachment of the hemispheres, means for securing a central weight, etc.; the exterior surface of a bob may not be substantially spherical; the exterior surface of a bob may not have cylindrical symmetry; the bore through a bob may not have cylindrical symmetry;; the functional components may include sound-producing or light-producing components; the functional components may include motion detecting components to control the sound-producing or light-producing components; the functional components may include sound-producing components which are designed to take advantage of doppler effects produced by the motions of the bobs; a swinging bob toy may or may not have a homogeneous interior density; a swinging bob toy may or may not have cylindrically symmetrical density; a swinging bob toy may have more or less than two bobs; a swinging bob toy may have different finger grips such as cylindrical end grips; a swinging bob toy may have fixed bobs as end grips provided at least two bobs can slide along the string; a swinging bob toy can be made from any material or combination of materials; a swinging bob toy can be made in any size; etc.

Accordingly, it is intended that the scope of the invention is determined not by the embodiments illustrated or the physical analyses motivating the illustrated embodiments, but, rather, by the appended Claims and their legal equivalents.

What is claimed is:

1. A toy comprising:

a flexible elongated tethering means;

a first stopper mounted on and adjacent a first end of said flexible elongated tethering means, said first stopper having a first stopper width greater than the diameter of said tethering means;

a second stopper mounted on and adjacent a second end of said flexible elongated tethering means, said second stopper having a second stopper width greater than the diameter of said tethering means, said tethering means being unbifurcated between said first stopper and said second stopper;

a first movable mass having a first bore therethrough through which said tethering means passes, said first bore of said first movable mass having a first bore diameter greater than the diameter of said tethering means and less than said first stopper width so as to allow said first movable mass to move freely along said tethering means but not pass over said first stopper; and a second movable mass having a second bore therethrough through which said tethering means passes, said second bore of said second movable mass having a second bore diameter greater than the diameter of said tethering means and less than said second stopper width so as to allow said second movable mass to move freely along said tethering means but not pass over said second stopper, said first movable mass being slidable freely and unimpeded along said tethering means between said first stopper and said second movable mass, and said second movable mass being slidable freely and unimpeded along said tethering means between said second stopper and said first movable mass.

2. The toy of claim 1 wherein said first movable mass has a first substantially spherical outer surface, and said second movable mass has a second substantially spherical outer surface.

3. The toy of claim 1 further including a first elongated extension extending from said first stopper and a second elongated extension extending from said second stopper.

4. The toy of claim 3 wherein said first and second extensions are flexible.

5. The toy of claim 4 wherein said first extension is a first portion of said tethering means between said first stopper and said first end of said tethering means, and said second extension is a second portion of said tethering means between said second stopper and said second end of said tethering means.

6. The toy of claim 5 further including a first bead on said first extension and a second bead on said second extension.

7. The toy of claim 6 wherein said first and second beads and said first and second end masses have substantially equal weights.

8. The toy of claim 1 wherein said first and said second movable masses weigh more than said first and second end stoppers.

* * * * *